US006857922B2

(12) United States Patent
Fernandez

(10) Patent No.: US 6,857,922 B2
(45) Date of Patent: Feb. 22, 2005

(54) FRONT FACING ROWING APPARATUS

(76) Inventor: Isidro Fernandez, 611 Centauro St. Altamira, Rio Piedras, PR (US) 00920

( * ) Notice: Subject to any disclaimer, the term of this patent is extended or adjusted under 35 U.S.C. 154(b) by 0 days.

(21) Appl. No.: 10/649,559

(22) Filed: Aug. 26, 2003

(65) Prior Publication Data

US 2004/0043679 A1 Mar. 4, 2004

Related U.S. Application Data

(60) Provisional application No. 60/406,645, filed on Aug. 28, 2002.

(51) Int. Cl.[7] ..... B63H 16/10
(52) U.S. Cl. ..... 440/101; 440/102
(58) Field of Search ..... 440/101–103; 416/69, 74

(56) References Cited

U.S. PATENT DOCUMENTS 1,476,987 A 12/1923 Larsen
2,051,424 A * 8/1936 Schenk ..... 440/103
2,429,790 A * 10/1947 Basta et al. ..... 440/102
3,677,216 A * 7/1972 Gentemann ..... 440/102
3,884,175 A 5/1975 Bellis
4,623,314 A 11/1986 Waugh
5,248,272 A * 9/1993 duPont ..... 440/103
5,647,782 A 7/1997 Henry
6,113,447 A 9/2000 Roy et al.

* cited by examiner

*Primary Examiner*—Ed Swinehart

(57) ABSTRACT

A rowing apparatus is provided for connection to a vessel and includes an oar direction-of-motion reversal assembly, fulcrum stabilizing means connected to the oar direction-of-motion reversal assembly, and vessel-to-oar-apparatus connection means connected to the fulcrum stabilizing means for connecting the apparatus to the vessel. Preferably, the oar direction-of-motion reversal assembly includes an oar handle portion, an oar blade portion, and a casement assembly for supporting the oar handle portion and the oar blade portion. A pair of oar direction-of-motion reversal assemblies are provided which provide a pair of oar handle portions and a pair of oar blade portions. The apparatus provides that a rower faces in the direction that the vessel is propelled when the rower pulls on the oar handle portions.

16 Claims, 4 Drawing Sheets

FIG 5
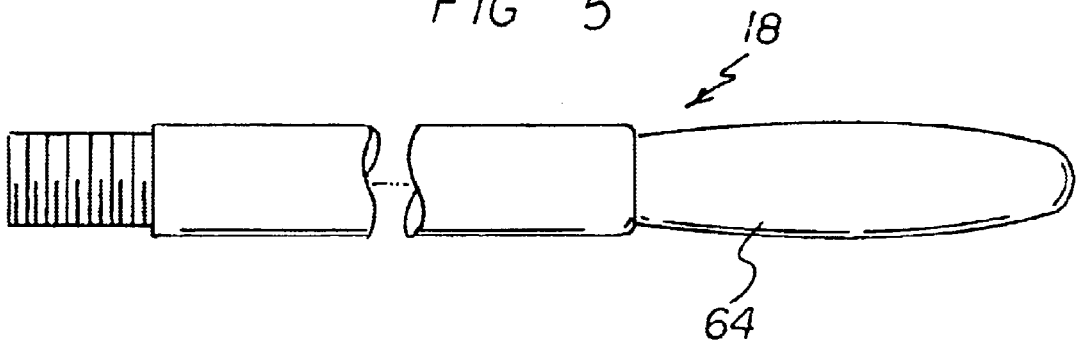
FIG 6
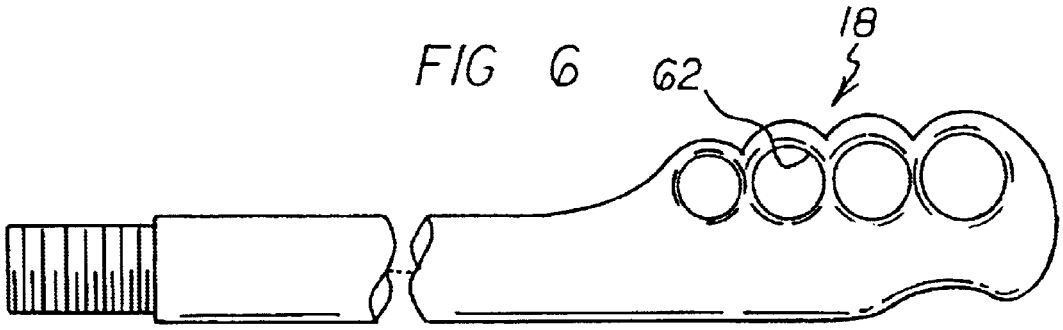
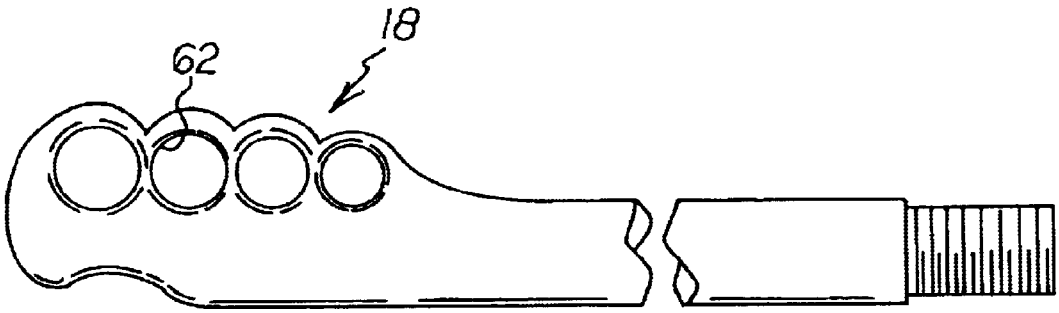
FIG 7

58
58
54
56
34
32

34
58
54
58
56
60
32

FRONT FACING ROWING APPARATUS

CROSS-REFERENCE TO RELATED APPLICATION

This application claims priority based upon my copending Provisional Application Ser. No. 60/406,645, filed Aug. 28, 2002.

BACKGROUND OF THE INVENTION

1. Field of the Invention

The present invention relates generally to row boats, and, more particularly, to row boats especially adapted for front facing rowing.

2. Description of the Prior Art

Conventionally, for a water-born vessel, e.g. a row boat, propelled by oars, a conventional oar includes an oar handle portion and an oar blade portion. The conventional oar is attached to the vessel at an oar fulcrum/pivot. The position of the oar handle portion with respect to the oar fulcrum/pivot determines the relative lengths of the first lever arm, from the end of the oar handle portion to the oar fulcrum/pivot, and of the second lever arm, from the oar fulcrum/pivot to the end of the oar blade portion. Also, with a conventional oar, both the oar handle portion and the oar blade portion rotate around the oar fulcrum/pivot in the same rotational direction. That is, when the oar handle portion rotates around the oar fulcrum/pivot in a clockwise direction, the oar blade portion also rotates around the oar fulcrum/pivot in a clockwise direction. Conversely, when the oar handle portion rotates around the oar fulcrum/pivot in a counterclockwise direction, the oar blade portion also rotates around the oar fulcrum/pivot in a counterclockwise direction.

Also, conventionally, when the oar handle portion is pushed downward, the oar blade portion is moved upward, such as out of the water, around the oar fulcrum/pivot. Also, conversely, when the oar handle portion is pulled upward, the oar blade portion is moved downward, such as into the water, around the oar fulcrum/pivot. In this respect, the conventional oar fulcrum/pivot serves as a fulcrum/pivot in substantially all directions—vertically, horizontally, and directions in between the vertical and the horizontal.

Moreover, with conventional oars, when a rower is sitting in the vessel, and the rower pulls the oar handle portions of a pair of rows toward the rower's chest, the operation of the oar blade portions in the water causes the vessel to move in the direction of the oar handle pulling. As a result, the vessel moves in a direction which is facing the rower's back. That is, the rower's back is facing forward, and the rower's front is facing backward with respect to the movement of the vessel in the water. To see where the vessel is moving, the rower must turn one's head to look over one's shoulder. When the rower is not looking over one's shoulder, the vessel is moving, and the rower may not see where the vessel is moving. Hazards, obstacles, and other vessels may not be seen by the rower. To remedy this situation, it would be desirable if the rower's front were facing forward and the rower's back were facing backward when the rower is rowing, and the vessel moves through the water.

Throughout the years, a number of innovations have been developed relating to row boats in which the rower's front is facing forward and the rower's back is facing backward when the rower is rowing, and the vessel moves through the water. In this respect, the following U.S. patents are representative of some of those innovations: U.S. Pat. Nos. 1,476,987, 3,884,175, 4,623,314, 5,647,782, and 6,113,447.

More specifically, U.S. Pat. No. 1,476,987 discloses a row boat which includes a front facing rowing apparatus. A linkage is used between the handle and the oar. Rather than have direction reversing linkages, it would be desirable if a front facing rowing apparatus had gears for reversing oar movement direction.

U.S. Pat. No. 3,884,175 discloses a front facing rowing apparatus which includes an axle or link between the direction reversing gear box and the row boat. Such an axle provides movement of the direction reversing means in only limited directions. Movement of the direction reversing means around the axle is easy. However, movement of the direction reversing means longitudinally with respect to the longitudinal axis of the axle is difficult. In this respect, it would be desirable if a front facing rowing apparatus were provided which permitted easy movement of the direction reversing means in a direction longitudinally with respect to the longitudinal axis of the direction reversing means. Alternatively, U.S. Pat. No. 3,884,175 provides a link between the direction reversing gear box and the boat. Such a link does not provide a stable orientation of the direction reversing gear box and the boat. In this respect, it would be desirable if a front facing rowing apparatus were provided in which a stable orientation of a direction reversing means and the boat were provided.

U.S. Pat. No. 4,623,314 discloses a front facing rowing apparatus in which an outrigger support is mounted on a base support so as to be reciprocally displacable longitudinally of a boat with simultaneous pivotal movement about a generally vertical axis spaced substantially from the inboard end of the outrigger support in the direction away from that in which the outrigger extends outboard of the base support. Also, a foot engagement is connectable to the outrigger support via a drive transmission formed and arranged so that the effective pivotal axis of the outrigger support is substantially inboard of the actual pivotal connection therebetween. The outrigger support is relatively complex to provide the reciprocal displacability of the outrigger support longitudinally of a boat with simultaneous pivotal movement about a generally vertical axis spaced substantially from the inboard end of the outrigger support in the direction away from that in which the outrigger extends outboard of the base support. In this respect, it would be desirable if a front facing rowing apparatus were provided which does not include a complex outrigger support to provide the reciprocal displacability of the outrigger support longitudinally of a boat, as described above.

U.S. Pat. No. 5,647,782 discloses a front facing rowing apparatus which includes a complex linkage for reversing rowing force between the handles and the oars. The desirability of direction reversing gears is mentioned above.

U.S. Pat. No. 6,113,447 discloses a watercraft which has an elongated hollow hull having a pair of integral outwardly and upwardly projecting outrigger wings, onto which are mounted oar mounting devices each having a flat casing attached to rods protruding out of the outrigger wings. The attachment of the casing to the rods is accomplished with pairs of balls on opposite ends of the casing and a socket installed on each of the rods. The sockets are longitudinally spaced-apart on the hull side edge portion, so as to allow the casing to swivel about an axis parallel to the watercraft longitudinal axis. The casing is engaged by a pair of oar members pivoted therein in the plane of the flat casing. A pair of wires interconnect the pivoted oar members inside the casing, to allow pivotal displacement of the oar members only in opposite directions. The arrangement of balls and sockets described hereinabove limits movement of casing holding the direction reversing means in a longitudinal direction with respect to the longitudinal axis of the boat.

Still other features would be desirable in a front facing rowing apparatus. The widths of boats vary and the heights of boats vary. Also, the width of people vary. With all of these variables in mind, it would be desirable if a front facing rowing apparatus were provided which included handles having adjustable lengths and oars that have adjustable lengths.

Thus, while the foregoing body of prior art indicates it to be well known to use a front facing rowing apparatus, the prior art described above does not teach or suggest a front facing rowing apparatus which has the following combination of desirable features: (1) has gears for reversing oar movement direction; (2) permits easy movement of the direction reversing means in a direction longitudinally with respect to the longitudinal axis of the direction reversing means; (3) provides a stable orientation of a direction reversing means and the boat; (4) does not include a complex outrigger support to provide reciprocal displacability of the outrigger support longitudinally of a boat; (5) includes handles having adjustable lengths; and (6) includes oars that have adjustable lengths. The foregoing desired characteristics are provided by the unique front facing rowing apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a rowing apparatus for connection to a vessel and includes an oar direction-of-motion reversal assembly, fulcrum stabilizing means connected to the oar direction-of-motion reversal assembly, and vessel-to-oar-apparatus connection means connected to the fulcrum stabilizing means for connecting the apparatus to the vessel.

Preferably, the oar direction-of-motion reversal assembly includes an oar handle portion, an oar blade portion, and a casement assembly for supporting the oar handle portion and the oar blade portion. A pair of oar direction-of-motion reversal assemblies are provided which provide a pair of oar handle portions and a pair of oar blade portions. The apparatus provides that a rower faces in the direction that the vessel is propelled when the rower pulls on the oar handle portions.

Each oar handle portion includes a handle grip portion and a handle arm portion connected to the handle grip portion. A handle pivot is attached to the handle arm portion. Handle gear teeth are attached to the handle arm portion. The handle grip portion can include a smooth gripping surface. Also, the handle grip portion can include finger reception channels.

Each oar blade portion includes an oar blade portion and a blade arm portion connected to the oar blade portion. An oar pivot is attached to the blade arm portion. Blade gear teeth are attached to the blade arm portion. The fulcrum stabilizing means are positioned between the handle pivot and the oar pivot. A handle pivot bearing is attached to the handle arm portion for receiving the handle pivot. An oar pivot bearing is attached to the blade arm portion for receiving the oar pivot.

The fulcrum stabilizing means include a first pivot/fulcrum member attached to the casement assembly, and the vessel-to-oar-apparatus connection means include a second pivot/fulcrum member connected to the vessel. The first pivot/fulcrum member is positioned between the handle pivot and the oar pivot. Preferably, the first pivot/fulcrum member is in a form of a ball, and the second pivot/fulcrum member is in a form of a socket block that receives the ball.

Each of the handle arm portion and the blade arm portion can include respective gear guide tongues for riding in complementary gear guide grooves in a top portion of the casement assembly. Each of the handle arm portion and the blade arm portion includes respective bearings for riding in a bottom portion of the casement assembly. The bearings can be ball bearings.

Preferably, an outer housing is provided for housing the casement assembly, the ball, and the socket block. The outer housing includes arm access channels. Elastic sealing boots are connected between the blade arm portion and the outer housing and between the handle arm portion and the outer housing for providing an elastic seal between the outer housing and the respective arm portions. The elastic sealing boots help prevent water from entering the oar direction-of-motion reversal assembly.

The vessel-to-oar-apparatus connection means can include support struts connected between the oar direction-of-motion reversal assembly and the vessel.

To provide adjustable length blade arm portions, each blade arm portion includes a first telescopic blade arm portion and a second telescopic blade arm portion received in the first telescopic blade arm portion. The first telescopic blade arm portion is locked with respect to the second telescopic blade arm portion by locking means. In one embodiment, the locking means include locking pins. In another embodiment, the locking means include locking threads.

In accordance with another aspect of the invention, a rowing vessel apparatus includes a vessel portion which includes a rower seating region which includes a seat assembly and rower foot placement members. A pair of vessel-to-oar-apparatus connection means are connected to the vessel portion. A pair of fulcrum stabilizing means are connected to the vessel-to-oar-apparatus connection means. A pair of oar direction-of-motion reversal assemblies are connected to the fulcrum stabilizing means. The vessel portion can have a relatively long length and a relatively narrow width.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved front facing rowing apparatus which has all of the advantages of the prior art and none of the disadvantages.

It is another object of the present invention to provide a new and improved front facing rowing apparatus which may be easily and efficiently manufactured and marketed.

It is a further object of the present invention to provide a new and improved front facing rowing apparatus which is of durable and reliable construction.

An even further object of the present invention is to provide a new and improved front facing rowing apparatus which is susceptible of a low cost of manufacture with regard to both materials and labor, and which accordingly is then susceptible of low prices of sale to the consuming public, thereby making such front facing rowing apparatus available to the buying public.

Still yet a further object of the present invention is to provide a new and improved front facing rowing apparatus which has gears for reversing oar movement direction.

Still another object of the present invention is to provide a new and improved front facing rowing apparatus that permits easy movement of the direction reversing means in a direction longitudinally with respect to the longitudinal axis of the direction reversing means.

Yet another object of the present invention is to provide a new and improved front facing rowing apparatus which provides a stable orientation of a direction reversing means and the boat.

Even another object of the present invention is to provide a new and improved front facing rowing apparatus that does not include a complex outrigger support to provide reciprocal displacability of the outrigger support longitudinally of a boat.

Still a further object of the present invention is to provide a new and improved front facing rowing apparatus which includes handles having adjustable lengths.

Yet another object of the present invention is to provide a new and improved front facing rowing apparatus that includes oars that have adjustable lengths.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 5 is a side view of one embodiment of an oar handle used with the invention.

FIG. 6 is a side view of a second embodiment of an oar handle used with the invention.

FIG. 7 is a side view of a handle matching the handle shown in FIG. 6.

DESCRIPTION OF THE PREFERRED EMBODIMENT

Figure 1:
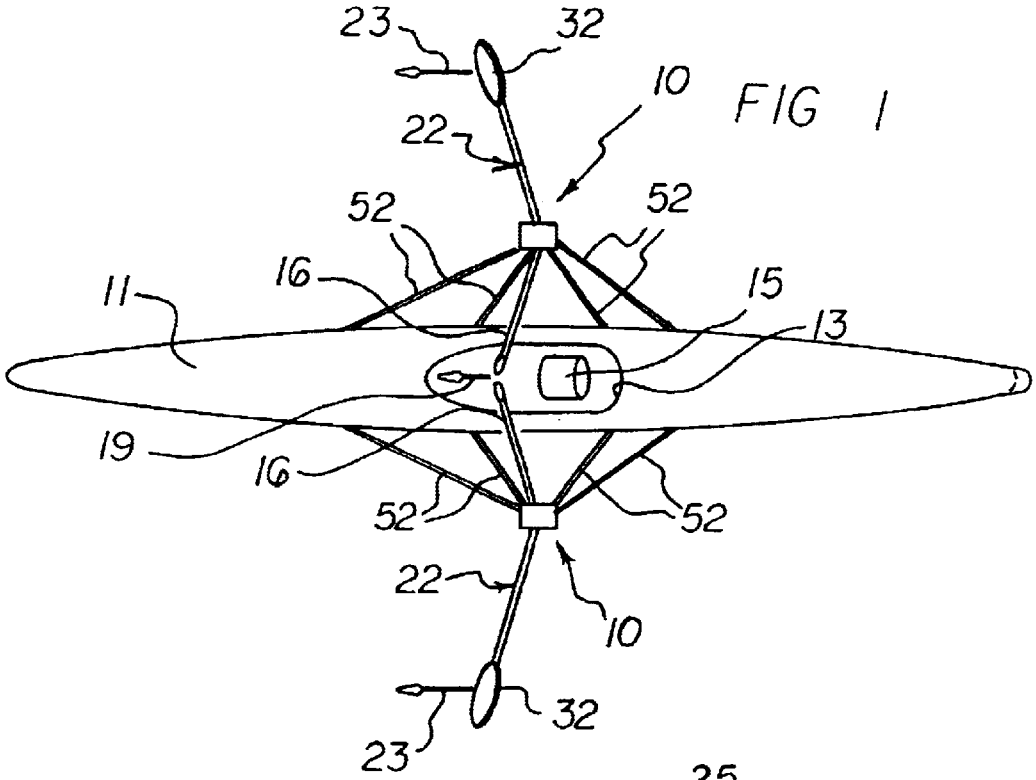
FIG. 1 is a top view showing a preferred embodiment of the front facing rowing apparatus of the invention, wherein the oar user has lifted the oars out of the water and is pushing on the oars to move them to a water engagement position.

With reference to the drawings, a new and improved front facing rowing apparatus embodying the principles and concepts of the present invention will be described.

Turning to FIGS. 1–4, there is shown an exemplary embodiment of the front facing rowing apparatus of the invention generally designated by reference numeral 10. In its preferred form, front facing rowing apparatus 10 is provided for connection to a vessel 11 and includes an oar direction-of-motion reversal assembly, fulcrum stabilizing means connected to the oar direction-of-motion reversal assembly, and vessel-to-oar-apparatus connection means connected to the fulcrum stabilizing means for connecting the apparatus to the vessel 11.

Preferably, the oar direction-of-motion reversal assembly includes an oar handle portion 16, an oar blade portion 22, and a casement assembly 24 for supporting the oar handle portion 16 and the oar blade portion 22. The oar handle portion 16 includes a handle grip portion 18. A handle arm portion 20 is connected to the handle grip portion 18. A handle pivot 28 is attached to the handle arm portion 20. Handle gear teeth 30 are attached to the handle arm portion 20.

As shown in FIG. 5, the handle grip portion 18 includes a smooth gripping surface 64. As shown in FIGS. 6 and 7, the handle grip portion 18 includes finger reception channels 62.

Preferably, the oar blade portion 22 includes an oar blade portion 32. A blade arm portion 34 is connected to the oar blade portion 32. An oar pivot 36 is attached to the blade arm portion 34. Blade gear teeth 38 are attached to the blade arm portion 34. The fulcrum stabilizing means are positioned between the handle pivot 28 and the oar pivot 36. A handle pivot bearing 48 is attached to the handle arm portion 20 for receiving the handle pivot 28. An oar pivot bearing 50 is attached to the blade arm portion 34 for receiving the oar pivot 36.

The fulcrum stabilizing means include a first pivot/fulcrum member 26 attached to the casement assembly 24. The vessel-to-oar-apparatus connection means include a second pivot/fulcrum member 40 connected to the vessel 11. The first pivot/fulcrum member 26 is positioned between the handle pivot 28 and the oar pivot 36. The first pivot/fulcrum member 26 is in a form of a ball 26, and the second pivot/fulcrum member 40 is in a form of a socket block 40 that receives the ball 26. The socket block 40 can be connected to the support struts 52 using screws 66.

Each of the handle arm portion 20 and the blade arm portion 34 includes respective gear guide tongues 42 for riding in complementary gear guide grooves in a top portion of the casement assembly 24. Each of the handle arm portion 20 and the blade arm portion 34 includes respective bearings 44 for riding in a bottom portion of the casement assembly 24. The bearings 44 can be ball bearings.

An outer housing 46 may be provided for housing the casement assembly 24, the ball 26, and the socket block 40. The outer housing 46 includes arm access channels 72. Elastic sealing boots 70 are connected between the blade arm portion 34 and the outer housing 46 and between the handle arm portion 20 and the outer housing 46 for providing an elastic seal between the outer housing 46 and the respective arm portions. The elastic sealing boots 70 can be made from elastic neoprene rubber. Alternatively, the outer housing 46 may be dispensed with entirely and only the elastic sealing boots 70 employed.

When desired, the vessel-to-oar-apparatus connection means include support struts 52 connected between the oar direction-of-motion reversal assembly and the vessel 11. Different vessels have different heights and different widths. The dimensions of the support struts 52 are selected to accommodate such heights and widths.

Also, to enable the rowing apparatus 10 of the invention to be used with a wide variety of vessels, the blade arm portions 34 are provided with adjustable length blade arm portions 34. More specifically, with reference to FIGS. 8 and 9, the second telescopic blade arm portion 56 is adjusted linearly with respect to the first telescopic blade arm portion 54.

Figures 8, 9:
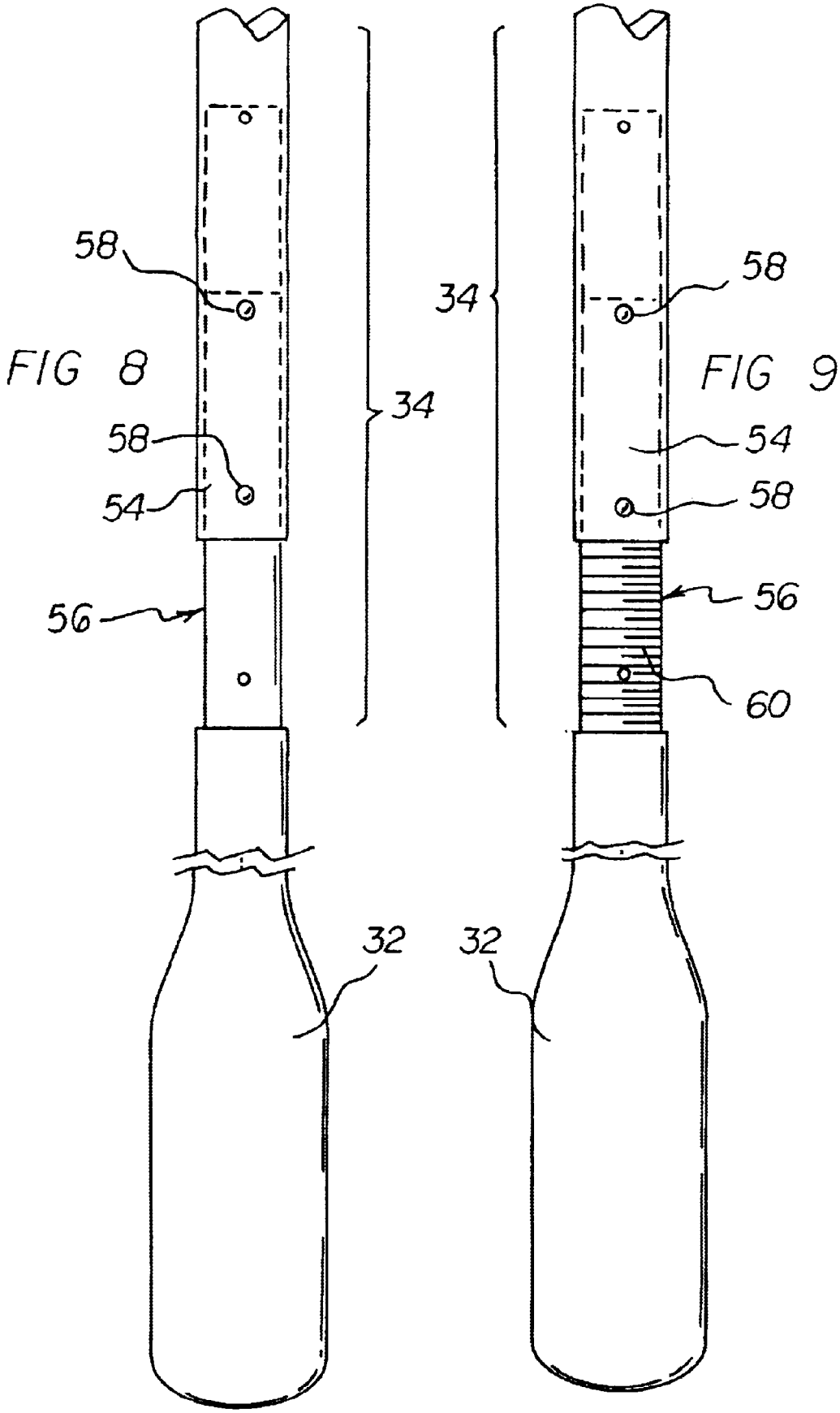
FIG. 8 is a top view of one embodiment of an oar portion of the invention.
FIG. 9 is a top view of one embodiment of an oar portion of the invention.

As shown in FIGS. 8 and 9, the blade arm portion 34 includes a first telescopic blade arm portion 54, and a second telescopic blade arm portion 56 received in the first telescopic blade arm portion 54. Locking means are provided for locking the first telescopic blade arm portion 54 to the second telescopic blade arm portion 56 at selected positions of adjustment. The first telescopic blade arm portion 54 and the second telescopic blade arm portion 56 constitute an adjustable length blade arm portion 34.

As shown in the embodiment in FIG. 8, the first telescopic blade arm portion 54 is received inside the second telescopic blade arm portion 56 and is locked thereto by locking pins 58. As shown in the embodiment in FIG. 9, the first telescopic blade arm portion 54 is received inside the second telescopic blade arm portion 56 and is locked thereto by locking threads 60. It is noted that the embodiment of the invention in FIG. 9 can also includes locking pins 58.

In accordance with another aspect of the invention, a rowing vessel apparatus includes a vessel portion 11 which includes a rower seating region 13 which includes a seat assembly 15 and rower foot placement members 17. Vessel-to-oar-apparatus connection means are connected to the vessel portion 11. Fulcrum stabilizing means are connected to the vessel-to-oar-apparatus connection means. An oar direction-of-motion reversal assembly is connected to the fulcrum stabilizing means. The vessel portion 11 can have a relatively long length and a relatively narrow width. The vessel portion 11 can be especially suitable for events in the Olympics.

The seat assembly 15 can be supported in tracks (not shown) inside the rower seating region 13. The feet of the rower can be strapped onto the rower foot placement members 17 with straps (not shown).

Figure 2:
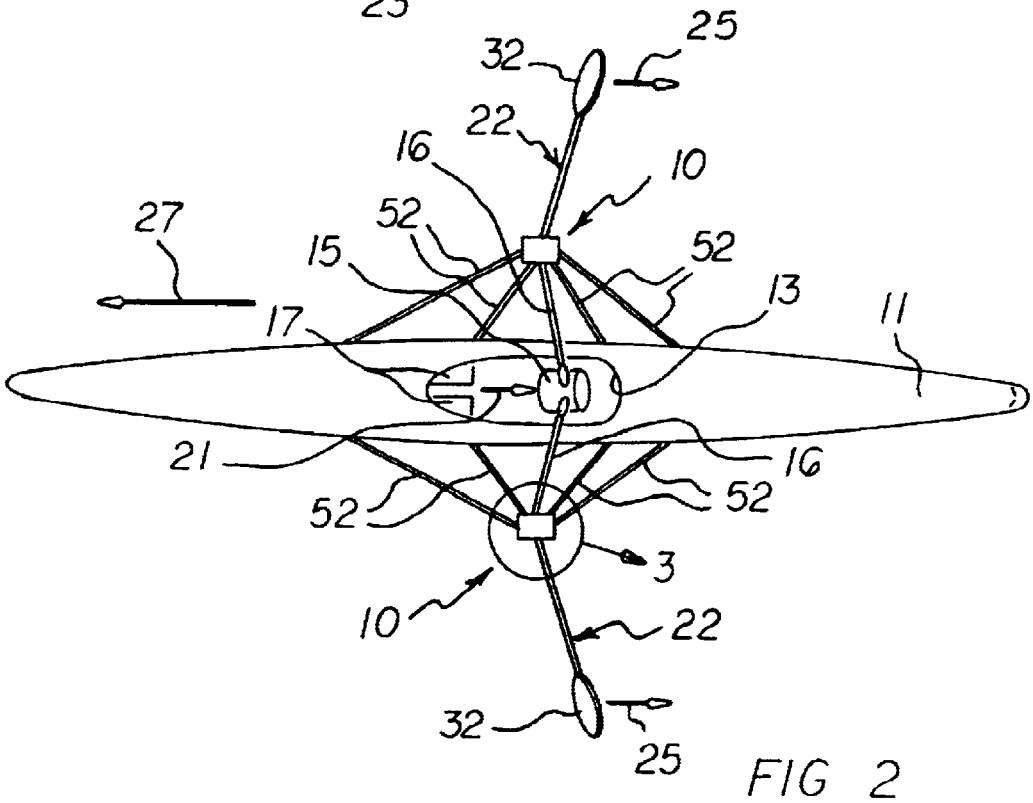
FIG. 2 is a top view of the embodiment of the front facing rowing apparatus shown in FIG. 1, wherein the oars have been immersed in the water, and the oar user is pulling on the oars, causing the boat to be propelled in the front-facing direction.
Figure 3:
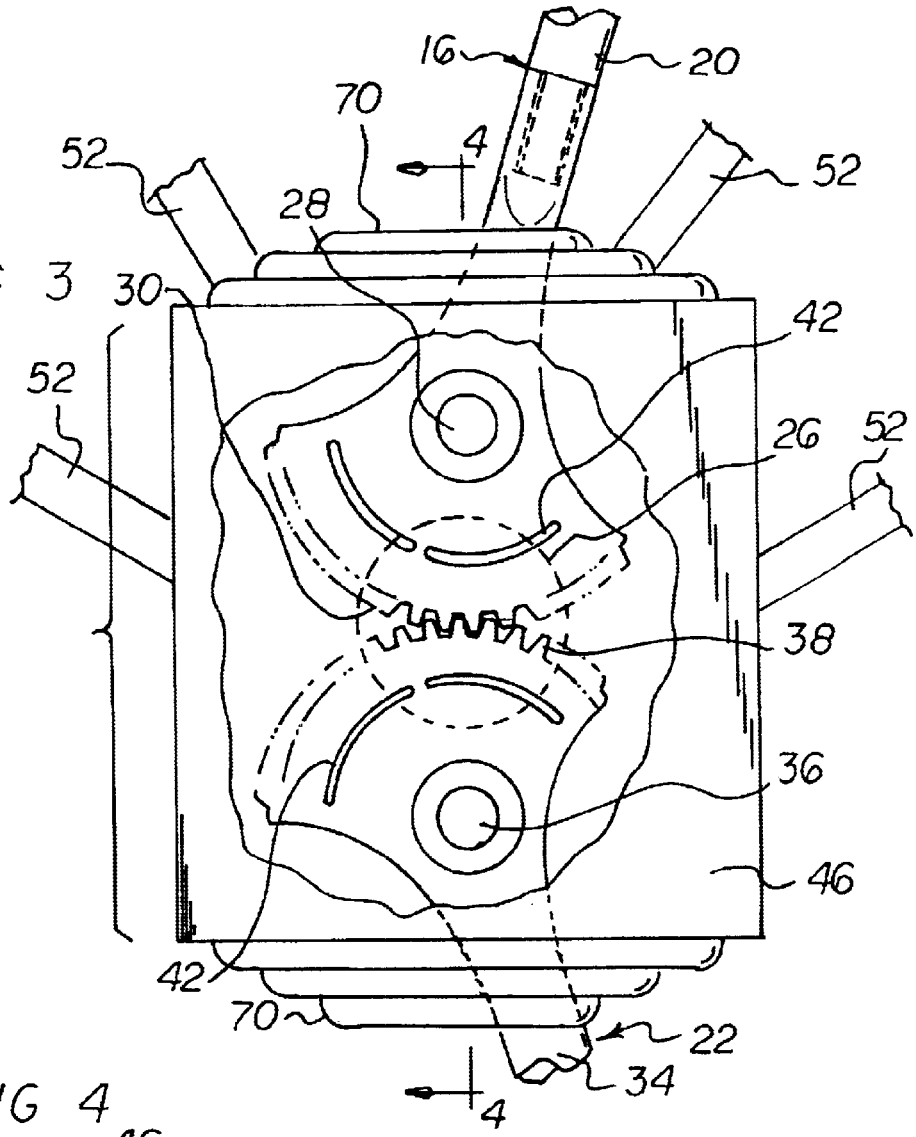
FIG. 3 is an enlarged, partially broken away, top view of the portion of the embodiment shown in circled region 3 of FIG. 2 cross-sectional view of the embodiment of the front facing rowing apparatus of FIG. 2 taken along line 3-3 thereof, showing a direction reversal mechanism.
Figure 4:
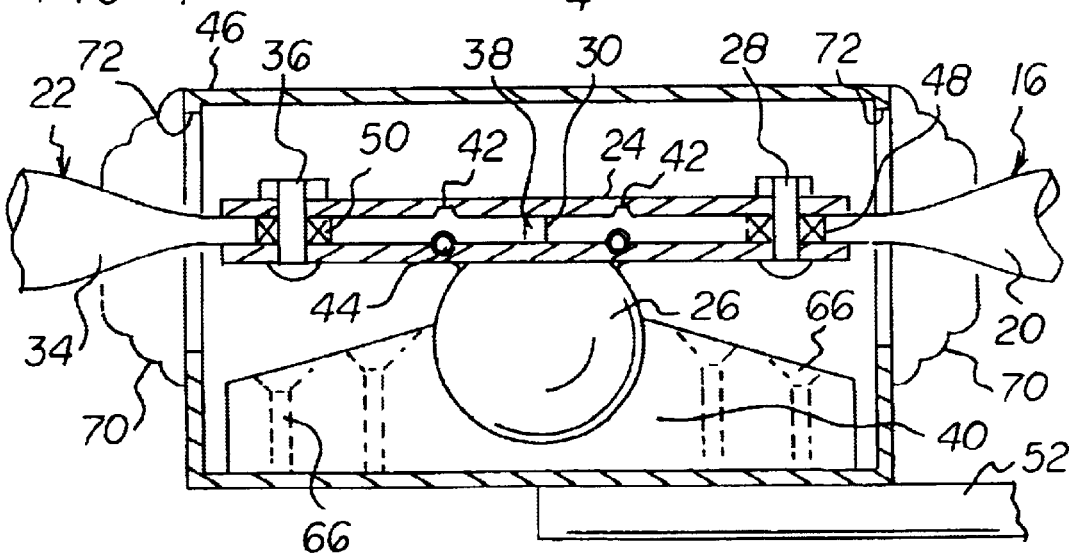
FIG. 4 is a cross-sectional view of the portion of the embodiment of the invention shown in FIG. 3 taken along line 4-4 thereof.

With special reference to FIGS. 1 and 2, to use the rowing apparatus 10 and the rowing vessel apparatus of the invention, a rower (not shown) sits in the seat assembly 15 and faces forward in the direction of directional arrow 19, shown in FIG. 1. The rower can place one's feet on the rower foot placement members 17. Moreover, the rower grasps the handle grip portions 18 and pushes downward on the oar handle portions 16 to lift the oar blade portions 22 out of the water. When this is done, the ball 26 rotates in the socket block 40 in a vertical plane. While holding onto the handle grip portions 18, the rower extends one's arms in the direction of directional arrow 19 so that the oar handle portions 16 are at their respective maximum positions towards the direction of the directional arrow 19. Also, as the rower moves the handle grip portions 18 in the direction of directional arrow 19, the oar blade portions 32 move in the same direction, that is in the direction of directional arrows 23.

Then, referring to FIG. 2, still holding the handle grip portions 18 with one's arms fully extended, the rower pulls up one's hands so that the oar blade portions 32 enter the water. When this is done, the ball 26 rotates in the socket block 40 in the opposite direction in the vertical plane. Then, the rower pulls the handle grip portions 18 towards one's chest in the direction shown by directional arrow 21, which is the backward direction. When this is done, with the oar blade portions 32 in the water, the oar blade portions 32 move in the same direction, that is in the backward direction shown by directional arrows 25. When this is done, the vessel portion 11 is propelled forward in the direction of directional arrow 27, which is the same direction that the rower is facing. Therefore, when the rower pulls the handle grip portions 18 towards one's chest, the vessel portion 11 is propelled in the water in the forward direction, which is the direction that the rower is facing. To continue propelling the vessel portion 11 in the forward direction, the rower repeats the above-described steps.

It is noted that, as described above, the force propelling the vessel portion 11 is derived from the arm action of the rower. To increase the propulsive force of the rower, the rower's legs can also be involved in assisting the pulling of the rower's arms towards one's chest. When this is done, the rower's torso, as well as one's arms, move in the direction of directional arrow 21 when the rower gives a propulsive stroke. To assist such torso movement, the rower can be seated on a seat assembly 15 that is on tracks. When the rower pulls in the direction of directional arrow 21, the rower's legs push in the opposite direction, in the direction of directional arrow 19, and the rower's legs extend in the direction of directional arrow 21, causing the rower and the seat assembly 15 to move in the direction of directional arrow 21. After the rowing stroke is over, the rower contracts one's legs in the direction of directional arrow 19, and the rower and the seat assembly 15 move back in the direction of directional arrow 19.

Inside the oar direction-of-motion reversal assembly, the following movements take place. When an oar handle portion 16 is move in a first direction, e.g. a clockwise direction, around the handle pivot 28, the handle gear teeth 30 engage the blade gear teeth 38 and cause the oar blade portion 22 to rotate around the oar pivot 36 in a second direction, e.g. the counterclockwise direction. Alternatively, when the oar handle portion 16 is moved in a counterclockwise direction, the oar blade portion 22 moves in a clockwise direction.

The components of the front facing rowing apparatus of the invention can be made from inexpensive and durable metal, wooden, and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved front facing rowing apparatus that is low in cost, relatively simple in design and operation, and which may advantageously has gears for reversing oar movement direction. With the invention, a front facing rowing apparatus is provided which permits easy movement of the direction reversing means in a direction longitudinally with respect to the longitudinal axis of the direction reversing means. With the invention, a front facing rowing apparatus provides a stable orientation of a direction reversing means and the boat. With the invention, a front facing rowing apparatus is provided which does not include a complex outrigger support to provide reciprocal displacability of the outrigger support longitudinally of a boat. With the invention, a front facing rowing apparatus is provided which includes handles having adjustable lengths. With the invention, a front facing rowing apparatus is provided which includes oars that have adjustable lengths.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A rowing apparatus for connection to a vessel, comprising:

an oar direction-of-motion reversal assembly, which includes an oar handle portion, an oar blade portion, and a casement assembly for supporting said oar handle portion and said oar blade portion, fulcrum stabilizing means connected to said oar direction-of-motion reversal assembly, wherein said fulcrum stabilizing means include a centrally located first pivot/fulcrum member attached to said casement assembly, and said vessel-to-oar-apparatus connection means include a centrally located second pivot/fulcrum member connected to the vessel, and vessel-to-oar-apparatus connection means connected to said fulcrum stabilizing means for connecting said apparatus to the vessel, wherein said oar handle portion includes a handle grip portion, a handle arm portion connected to said handle grip portion, a handle pivot attached to said handle arm portion, and handle gear teeth attached to said handle arm portion, wherein said oar blade portion includes an oar blade portion, a blade arm portion connected to said oar blade portion, an oar pivot attached to said blade arm portion, and blade gear teeth attached to said blade arm portion, and wherein said fulcrum stabilizing means is positioned between said handle pivot and said oar pivot, said apparatus further including:

an outer housing for housing said casement assembly, said first pivot/fulcrum member, and said second pivot/fulcrum member.

2. The apparatus of claim 1 wherein said handle grip portion includes a smooth gripping surface.

3. The apparatus of claim 1 wherein said handle grip portion includes finger reception channels.

4. The apparatus of claim 1, further including:

a handle pivot bearing, attached to said handle arm portion, for receiving said handle pivot, and an oar pivot bearing, attached to said blade arm portion, for receiving said oar pivot.

5. The apparatus of claim 1 wherein said first pivot/fulcrum member is positioned between said handle pivot and said oar pivot.

6. The apparatus of claim 1 wherein:

said first pivot/fulcrum member is in a form of a ball, and said second pivot/fulcrum member is in a form of a socket block that receives said ball.

7. The apparatus of claim 1 wherein each of said handle arm portion and said blade arm portion include respective gear guide tongues for riding in complementary gear guide grooves in a top portion of said casement assembly.

8. The apparatus of claim 1 wherein each of said handle arm portion and said blade arm portion include respective bearings for riding in a bottom portion of said casement assembly.

9. The apparatus of claim 8 wherein said bearings are ball bearings.

10. The apparatus of claim 1 wherein said outer housing includes arm access channels.

11. The apparatus of claim 10, further including:

elastic sealing boots connected between said blade arm portion and said outer housing and between said handle arm portion and said outer housing for providing an elastic seal between said outer housing and said respective arm portions.

12. The apparatus of claim 1 wherein said vessel-to-oar-apparatus connection means include support struts connected between said oar direction-of-motion reversal assembly and the vessel.

13. The apparatus of claim 1 wherein said blade arm portion includes:

a first telescopic blade arm portion, and a second telescopic blade arm portion received in said first telescopic blade arm portion.

14. The apparatus of claim 13 wherein said first telescopic blade arm portion is received inside said second telescopic blade arm portion and is locked thereto by locking pins.

15. The apparatus of claim 14 wherein said first telescopic blade arm portion is received inside said second telescopic blade arm portion and is locked thereto by locking threads.

16. A rowing vessel apparatus, comprising:

a vessel portion which includes a rower seating region which includes a seat assembly and rower foot placement members, an oar direction-of-motion reversal assembly, which includes an oar handle portion, an oar blade portion, and a casement assembly for supporting said oar handle portion and said oar blade portion, fulcrum stabilizing means connected to said oar direction-of-motion reversal assembly, wherein said fulcrum stabilizing means include a centrally located first pivot/fulcrum member attached to said casement assembly, and said vessel-to-oar-apparatus connection means include a centrally located second pivot/fulcrum member connected to the vessel, and vessel-to-oar-apparatus connection means connected to said fulcrum stabilizing means for connecting said apparatus to the vessel, said apparatus further including:

an outer housing for housing said casement assembly, said first pivot/fulcrum member, and said second pivot/fulcrum member.

* * * * *